US007194779B2

(12) United States Patent
Trask

(10) Patent No.: US 7,194,779 B2
(45) Date of Patent: Mar. 27, 2007

(54) VEHICLE STAND SYSTEM

(76) Inventor: John Peter Trask, Sunnymount Nurseries, Over Stratton, South Petherton, Somerset. (GB) TA13 5LG ( * ) Notice: Subject to any disclaimer, the term of this patent is extended or adjusted under 35 U.S.C. 154(b) by 0 days.

(21) Appl. No.: 10/367,868

(22) Filed: Feb. 12, 2003

(65) Prior Publication Data

US 2004/0154111 A1 Aug. 12, 2004

(51) Int. Cl.
*E01D 1/00* (2006.01)

(52) U.S. Cl. ..... 14/69.5; 254/88

(58) Field of Classification Search ..... 14/69.5; 254/88

See application file for complete search history.

(56) References Cited

U.S. PATENT DOCUMENTS 1,855,949 A * 4/1932 Dubroca ..... 254/88
1,993,387 A * 3/1935 Smith ..... 72/386
3,917,226 A * 11/1975 Palmer ..... 254/88
3,917,227 A * 11/1975 West ..... 254/88
4,063,616 A * 12/1977 Gutierrez ..... 182/17
4,726,516 A * 2/1988 Cree ..... 238/10 R
4,828,222 A * 5/1989 Rossato ..... 254/88
4,920,596 A * 5/1990 Stevens ..... 14/69.5
4,920,597 A * 5/1990 Hamilton ..... 14/69.5
5,781,954 A * 7/1998 Mayer ..... 14/69.5

FOREIGN PATENT DOCUMENTS

GB 2088821 A * 6/1982
JP 08004462 A * 1/1996

* cited by examiner

*Primary Examiner*—Gary S. Hartmann
(74) *Attorney, Agent, or Firm*—Melvin I. Stoltz

(57) ABSTRACT

A vehicle stand system comprises four stands (1, 2, 3 and 4) each of which includes an upwardly presented support surface for supporting a wheel of a vehicle, two bridge pieces (5 and 6) having means for releasable attachment to the stands (1, 2, 3 and 4) whereby the bridge pieces (5 and 6) can be arranged to interconnect the stands (1, 2, 3 and 4), and two ramps (7 and 8) having means for releasable attachment to the stands (1, 2, 3 and 4).

11 Claims, 8 Drawing Sheets

VEHICLE STAND SYSTEM

FIELD OF THE INVENTION

This invention relates to a vehicle stand system, i.e. to a system for supporting a vehicle above ground level at a height such as to enable maintenance work, inspection and the like to be carried out on the underside of the vehicle.

Vehicle ramps are well known items of workshop equipment and are used extensively by those who need to work on or inspect the undersides of their own vehicles. Each ramp is a floor-standing metal structure normally consisting of a short slope leading to a small raised platform which is typically about 250 mm. above floor level. The whole ramp/platform is suitably sized and sufficiently strong to accommodate the weight of a vehicle road wheel plus that part of the vehicle supported by the road wheel.

The ramps are normally used in pairs and one end of a vehicle is driven up onto the ramps in order to increase the ground clearance beneath the vehicle by the height of a ramp. This enables underside inspections or repair work to be carried out without the use of a pit or a vehicle lift.

Known forms of vehicle ramps are shown in British Patent Specifications Nos. 261,098; 2,213,116; 2,284,405 and 2,332,416.

There are five main drawbacks to the use of standard ramps, as follows:

1) the front or rear spoilers fitted to some modern vehicles are so close to the ground that they come into contact with the ramp long before the vehicle wheels begin to climb the ramp, 2) if the vehicle tyres or the ramps are wet it can be difficult for the vehicle's driving wheels to gain sufficient traction on the relatively steep, sloping part of the ramp to enable the vehicle to ascend in a controlled manner, 3) if the driving wheels of the vehicle are to remain on the ground and the non-driving wheels are to be "pushed" up the ramp, either one or both of the steep standard ramps simply get pushed along the ground rather than raising the vehicle, 4) if the above drawbacks are resolved by simply making the slope of the ramp longer and, therefore, less steep, the fourth inherent drawback is made worse. Thus, once the vehicle is on the raised platform part of the ramp, the sloping part of the ramp not only becomes temporarily redundant but actually hinders work, such as sill repairs, being done on the lower sides of the vehicle. The sloping part of the ramp also impedes side access for such service aids as "car creepers" and trolley jacks. In addition, the sloping part of the ramp can obstruct access to the vehicle's jacking points, which are almost invariably situated immediately behind the front wheels and just in front of the rear wheels. This prevents conventional jacks being used at these recommended points, when raising a vehicle further, for example, to remove wheels, and 5) the ramps can only be used to raise one end of a vehicle at a time and, therefore, once on the ramps, the vehicle remains at a steep angle to the horizontal. This can be a hindrance for certain types of work, for example, changing engine oil. One solution to this is to use the ramps on a steeply sloping surface, so that the angle of the ramps is counteracted by the slope of the ground. This is usually inconvenient and very dangerous.

It is accordingly an object of the present invention to provide a vehicle stand system which can be used for the purposes outlined above.

SUMMARY OF THE INVENTION

According to the present invention there is provided a vehicle stand system comprising a plurality of stands each of which includes an upwardly presented support surface for supporting a wheel of a vehicle, a plurality of ramps having means for releasable attachment to the stands and bridge pieces having means for releasable attachment to the stands whereby the bridge pieces can be arranged to interconnect the stands, the bridge pieces being adjustable in length whereby the spacing between the stands can be adjusted in dependence on the spacing between the front and rear wheels of the vehicle.

The bridge pieces are preferably of channel-section.

The bridge pieces preferably include platforms mounted on castors which are movable between ground-engaging positions (to facilitate movement of the bridge pieces into and out of engagement with the stands) and raised positions clear of the ground.

The means for releasable attachment of the bridge pieces to the stands are preferably such that, when the castors are moved from their ground-engaging positions into their raised positions, the releasable attachment means are moved into engagement with co-operating means on the stands. The arrangement is preferably also such that disengagement of the releasable attachment means is effected by moving the castors from their raised positions into their ground-engaging positions.

A gauge bar is preferably provided for interconnecting two of the stands. The gauge bar is preferably adjustable in length in dependence on the spacing of the front or rear wheels of the vehicle and is preferably provided at its ends with means for releasable attachment to the stands.

The ramps are preferably of channel section and provided at their upper ends with means for releasable attachment to the stands.

DESCRIPTION OF THE PREFERRED EMBODIMENT

Figure 1:
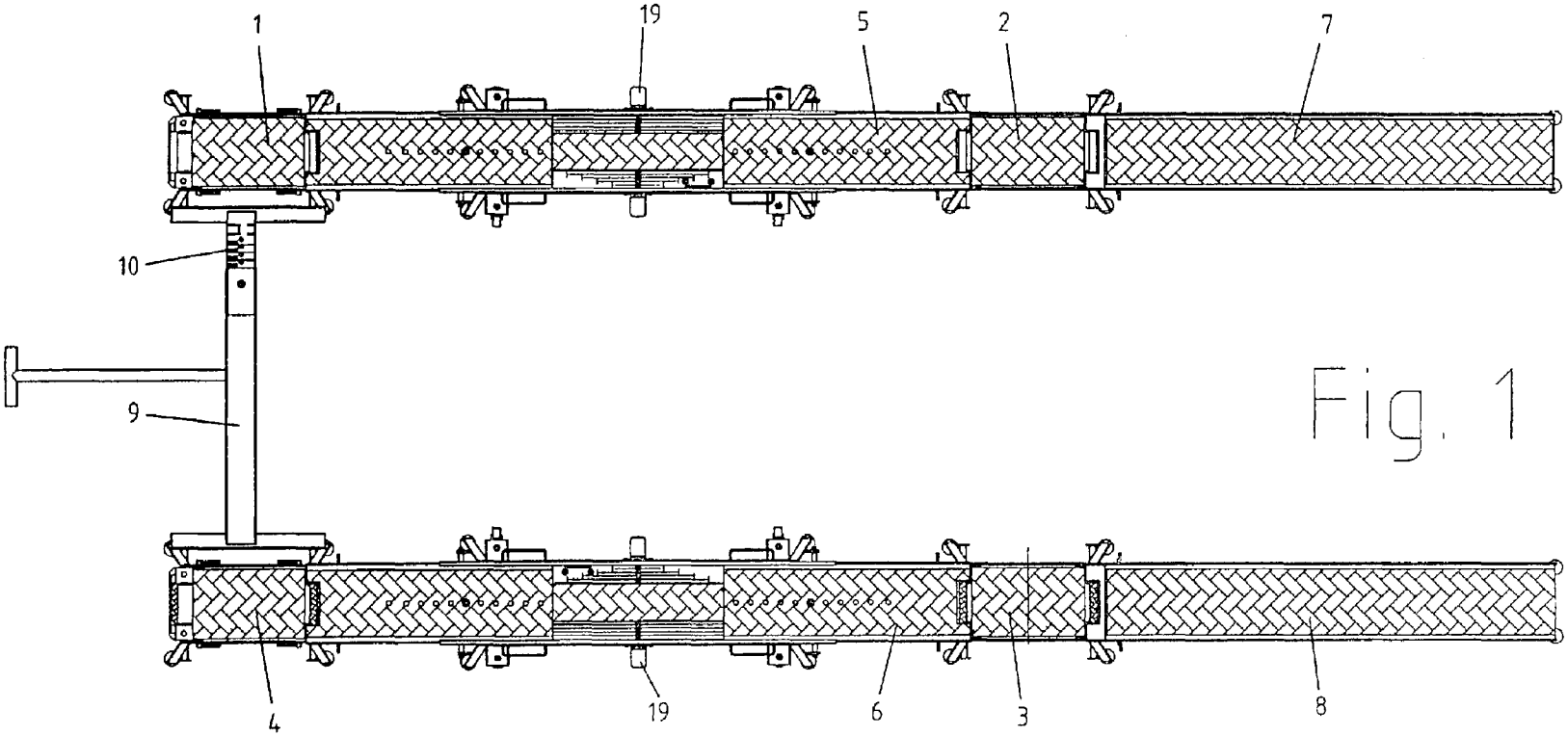
FIG. 1 is a plan view of a vehicle stand system comprising four stands, two bridges, two ramps and a gauge bar.
Figure 2:
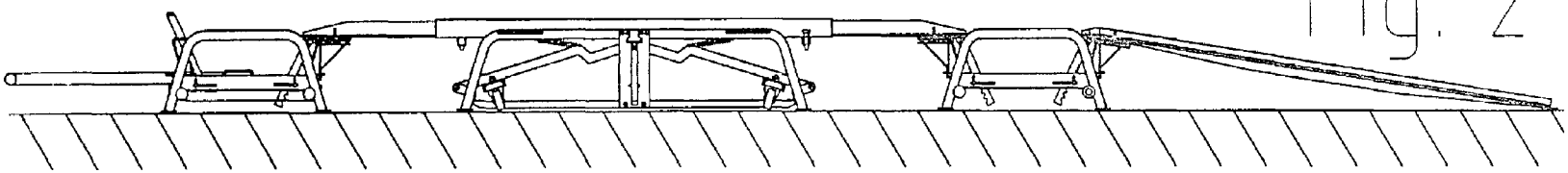
FIG. 2 is a side view of the vehicle stand system of FIG. 1.
Figure 3:
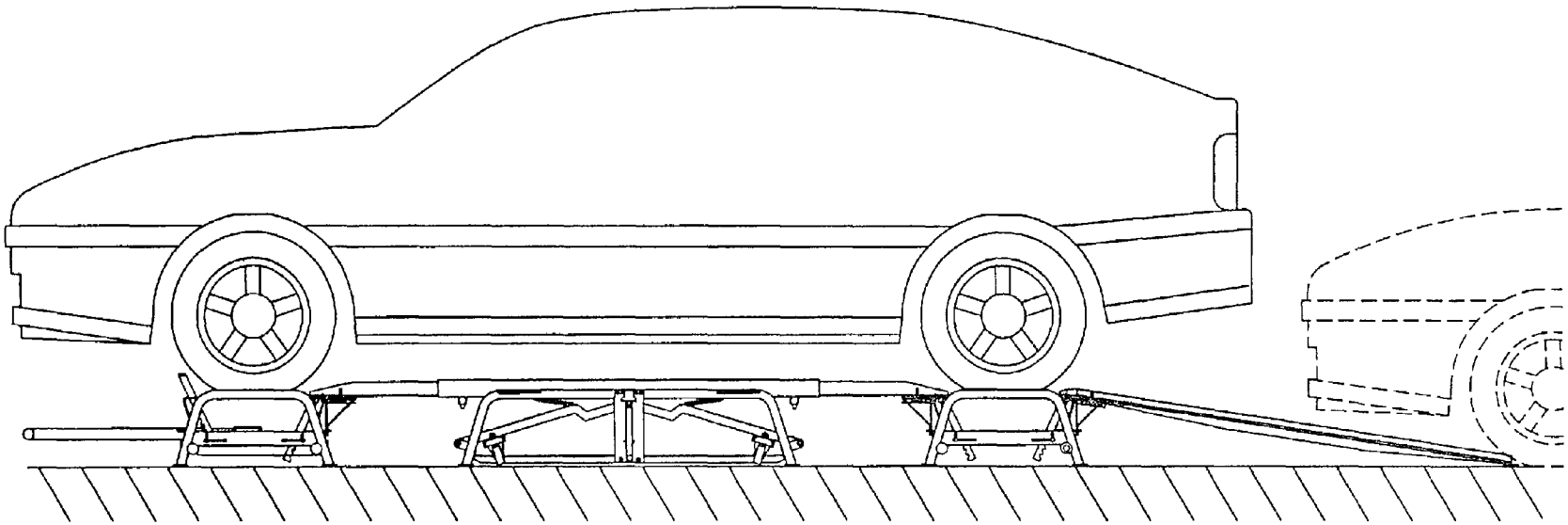
FIG. 3 is a side view as per FIG. 2 showing a vehicle correctly positioned on the stands in readiness for removal of the bridges, ramps and gauge bars and also showing, in dashed outline, the clearance between a vehicle spoiler and the ramps as the vehicle is moved onto the stand system.

The vehicle stand system shown in the drawings includes four stands 1, 2, 3 and 4, two bridges 5 and 6, two ramps 7 and 8 and a gauge bar 9, all formed as metal fabrications.

Figure 7A:
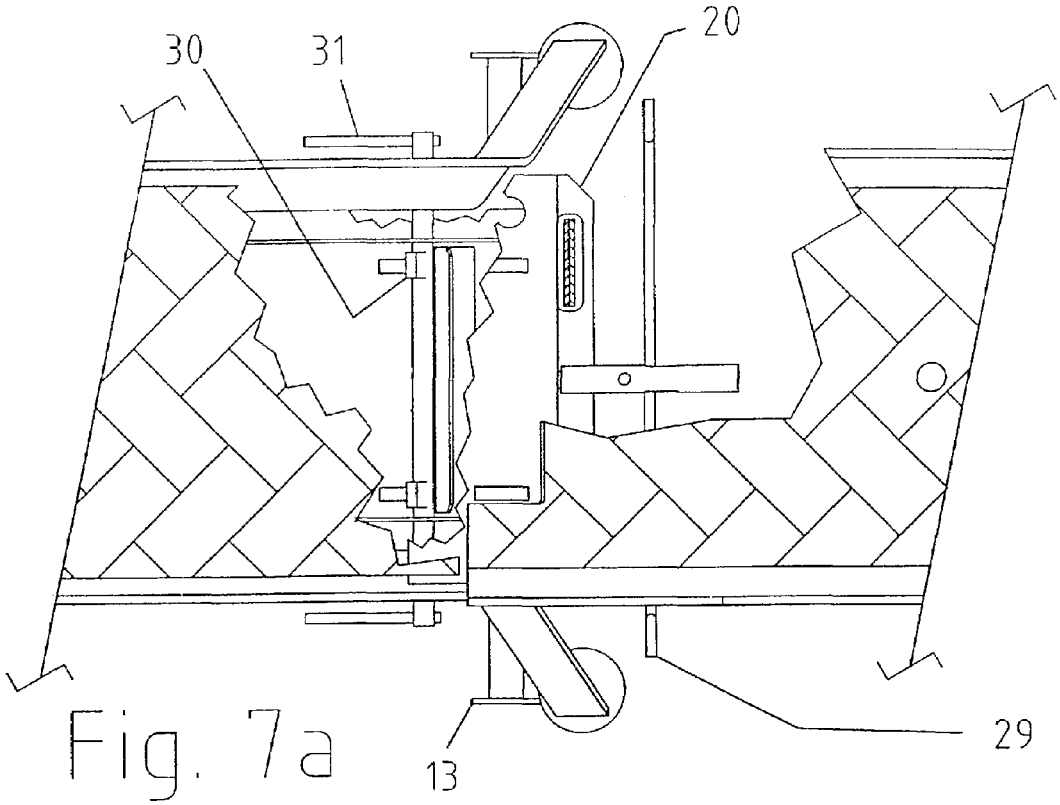
FIGS. 7*a* and 7*b* are part-sectional side elevation and plan views of a stand and one end of a bridge showing the means for releasable attachment of the bridge to the stand, and also showing a raisable stop and its height control mechanism, anti-tipping tongues and pegs engaged in a stand latch plate and connection locking bolts.
Figure 7B:
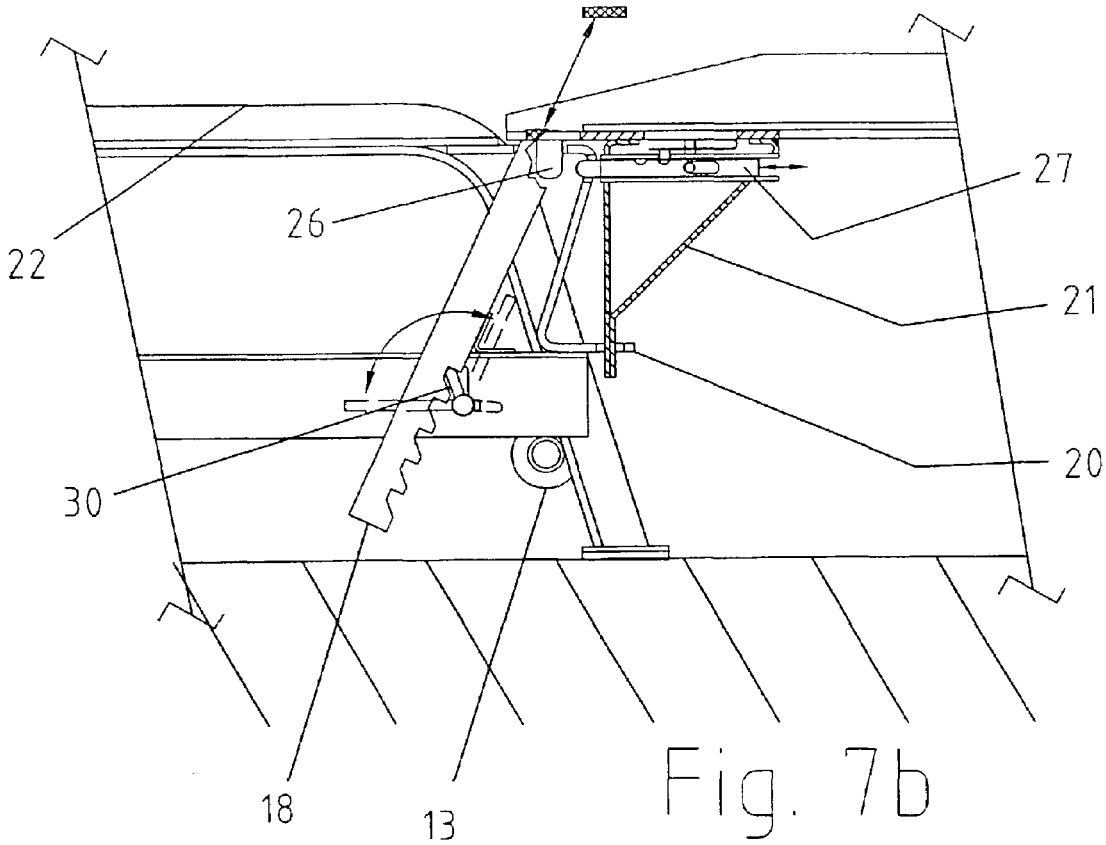

The stands 1, 2, 3 and 4 are of identical construction and each is of rectangular form in plan view with upwardly presented horizontal supported surfaces bounded at their sides by side walls 22 and with raisable stops 18 at their two ends. As shown in FIGS. 7*a* and 7*b*, latch brackets 20 are provided at the two ends of each stand 1, 2, 3, 4 for releasable engagement with co-operating formations 21 and 26 at each end of each bridge 5, 6 and with co-operating formations 23 and 26 on each ramp 7, 8. Flanged attachment points 13 are also provided at the sides of the stands 1, 2, 3, 4.

Figure 8B:
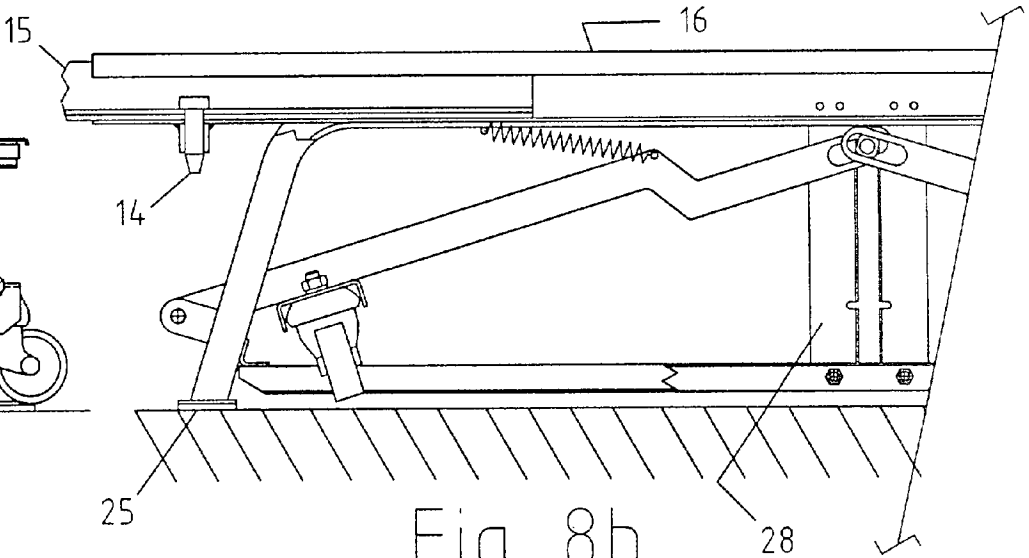
FIGS. 8*a* and 8*b* are a part-sectional end view and a partial side view of a bridge, showing a raising mechanism and a bridge extension locking pin.
Figure 8A:
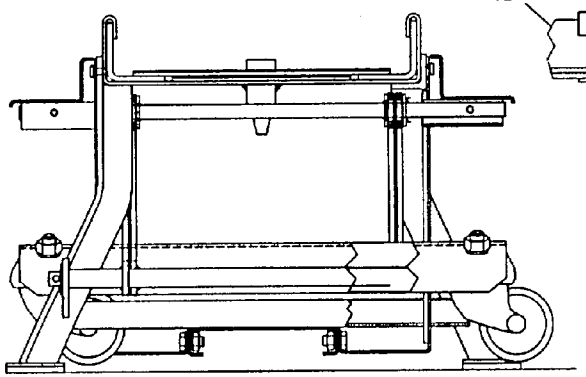
Figure 10:
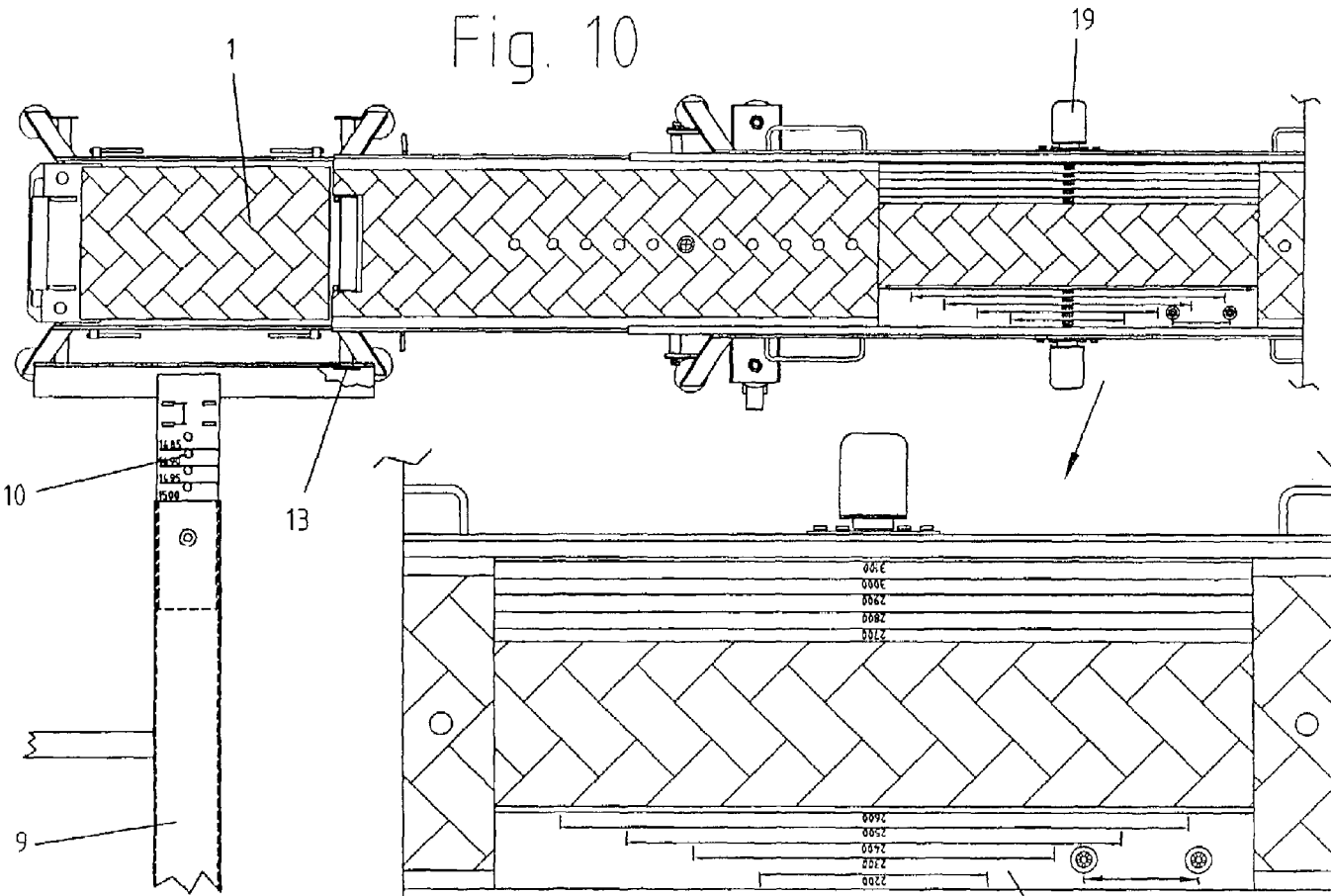
FIG. 10 is a detail plan view showing a stand, one end of a bridge and one end of the gauge bar, and illustrating the means of releasable attachment of the gauge bar to the stand.
Figure 11:
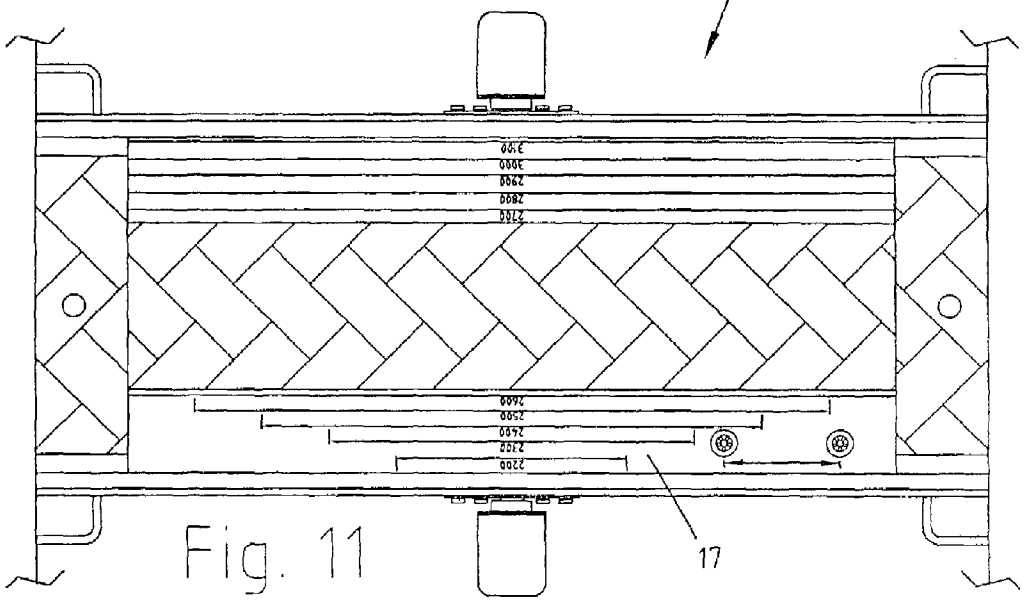
FIG. 11 is an enlarged detail plan view of part of FIG. 10 showing the vehicle wheel base scale markings.

As shown in FIGS. 8*a* and 8*b*, each bridge 5, 6 includes a fixed centre section 16 and a pair of channel-form end sections 15 which are movable relative to the centre section 16 and can be fixed against movement relative to the centre section 16 by means of pegs, bolts or catches 14. The centre section 16 of each bridge 5, 6 carries a scale 17 (see FIGS. 10 and 11).

Figure 9:
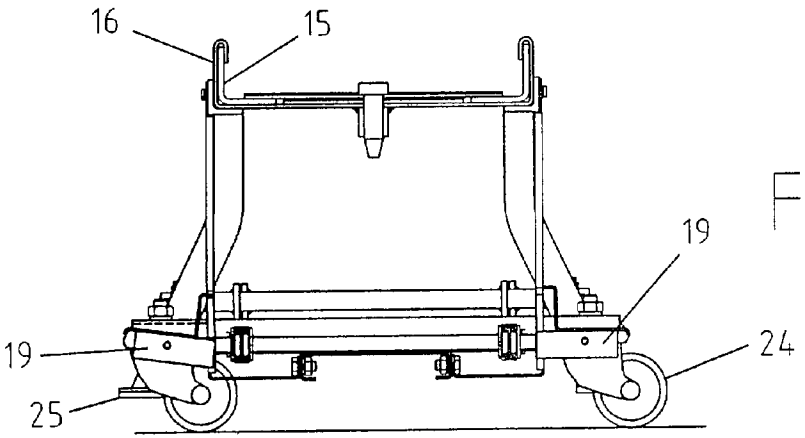
FIG. 9 is a sectional view of a bridge on the centre line of the bridge showing the bridge raised onto its castor wheels and locked in position by its left-hand pedal which has been tilted into engagement with a horizontal slot in a side bracket.

The bridges 5, 6 are mounted on castor wheels 24 which are so attached to the body portions of the bridges 5, 6 as to be movable between ground-engaging positions (as shown in the drawings) and raised positions (in which they are clear of the ground). When the castor wheels 24 are in their raised positions, plate-like feet 25 (see FIGS. 8*b* and 9) rest on the ground to provide firm support for the bridges 5, 6. Movement of the castor wheels 24 between their ground-engaging positions and their raised positions is effected by means of pedals 19 (see FIG. 9). Either or both pedals 19 on each bridge 5, 6 can be locked in the down position by tilting it about its pivot axis so that the upper edge thereof engages in a horizontal slot in a side bracket 28 (see FIG. 8*b*).

Figure 4:
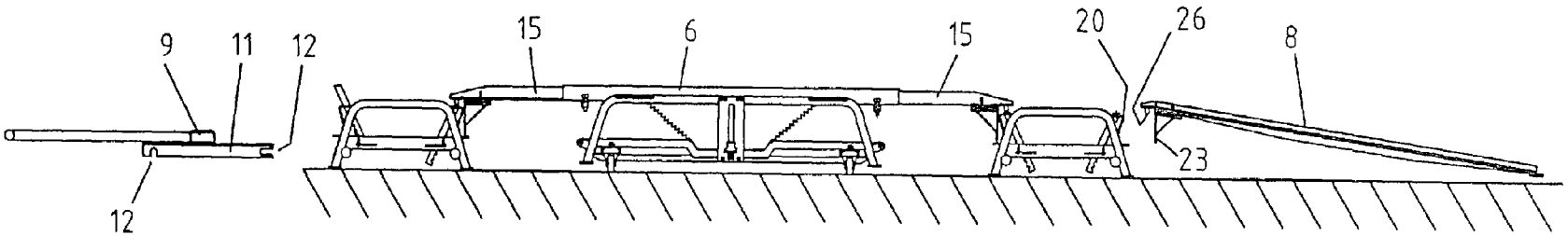
FIG. 4 is a side elevation of the vehicle stand system showing a bridge in its raised position in readiness for separation from the associated stands and showing a ramp and the gauge bar separated from the stands.
Figure 5:
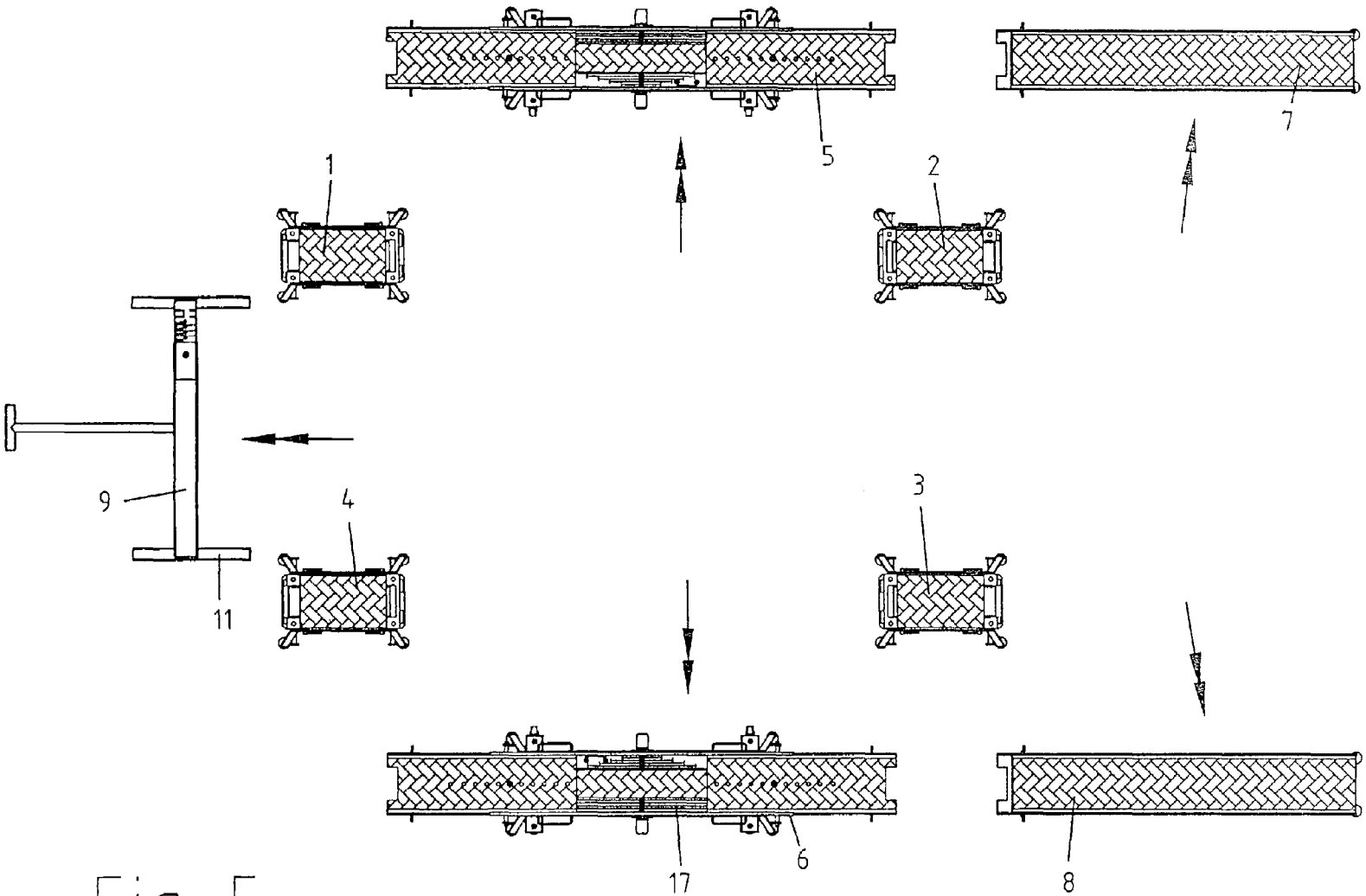
FIG. 5 is a plan view of the components of the vehicle stand system showing the stands in the positions which they would occupy when supporting a vehicle, and with the bridges, ramps and gauge bar separated from the stands.
Figure 6:
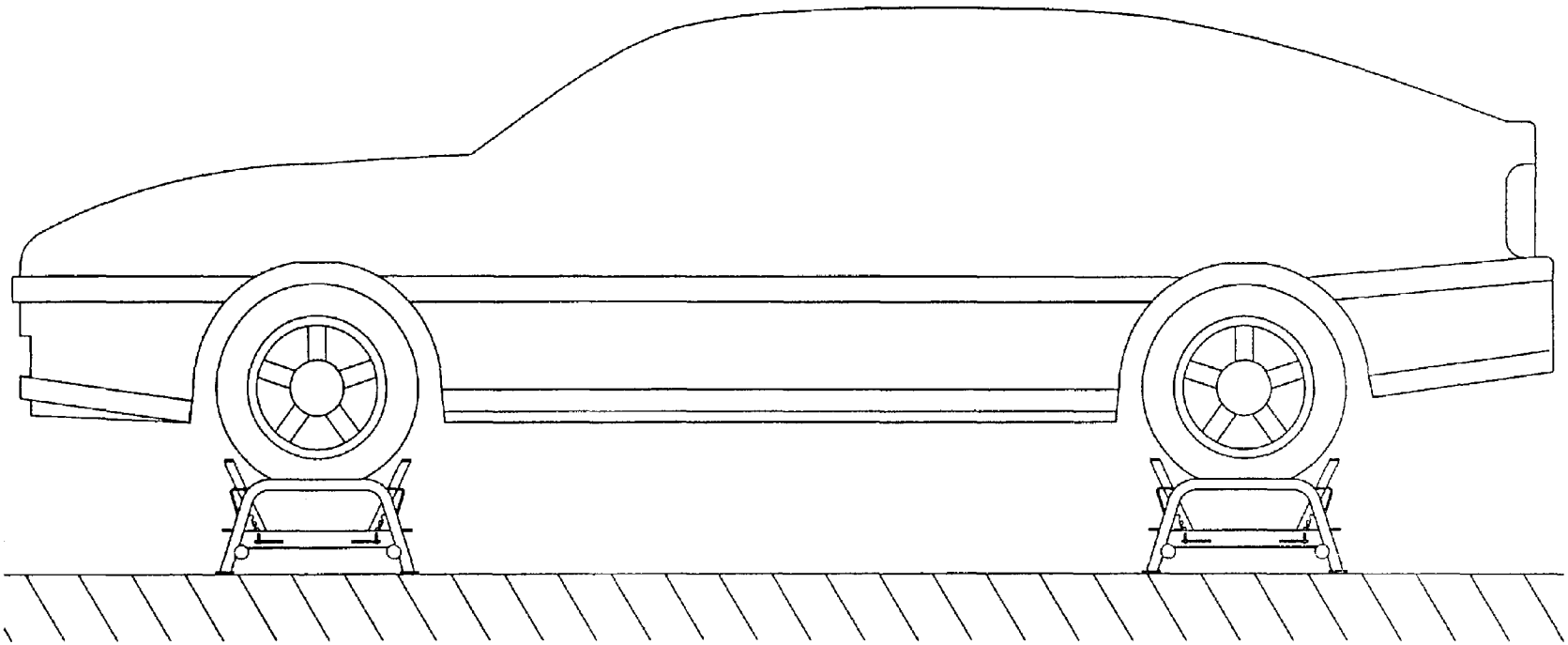
FIG. 6 is a side view of a vehicle on the stands with all stops raised.

To set up the vehicle stand system, a measurement is taken of the vehicle's track width. The gauge bar 9 is unlocked and then adjusted in width so that it approximates to the width of the vehicle's track—the width being indicated on a scale 10 on the gauge bar 9. The gauge bar 9 is then set or "locked" at this width before being attached between two of the stands. In the arrangement shown in FIG. 1, the gauge bar 9 is attached between stands 1 and 4. The gauge bar 9 is provided at its ends with brackets 11 formed with open-ended slots 12 (see particularly FIG. 4) which are fitted over the flanged attachment points 13 at the sides of the stands 1 and 4.

The length of each bridge 5, 6 is then adjusted so that it approximately matches the wheel base dimension of the vehicle on which work is to be carried out. To do this, the pegs, bolts or catches 14 are released and the channel-form end sections 15 are moved inwardly or outwardly relative to the fixed centre sections 16 of the bridges 5, 6. Once the bridges 5, 6 have been set to the correct length, as shown on the scales 17, the pegs, bolts or catches 14 are returned to their locking positions to prevent movement of the end sections 15 relative to the centre sections 16 of the bridges 5, 6. The bridges 5, 6 are then positioned appropriately relative to the two stands 1 and 4 at either end of the gauge bar 9. The two remaining stands 2, 3 are then positioned at the free ends of the bridges 5, 6 with latch brackets 20 on the four stands 1, 2, 3 and 4 in register with co-operating formations 21 and 26 at the ends of the bridges 5, 6. The castor wheels 24 on the bridges 5, 6 are then allowed to move, by releasing the tilted pedal(s) 19, from their ground-engaging positions (as shown in the drawings) into their raised positions, thereby lowering the end sections 15 of the bridges 5, 6 and moving the co-operating formations 23 and 26 on the bridges 5, 6 into interlocking engagement with the latch brackets 20 on the four stands 1, 2, 3 and 4. For added security, locking bolts 27 (see FIG. 7*b*) are engaged into latch brackets 20 by sliding handles 29 towards the associated stand 1, 2, 3, 4.

The two ramps 7 and 8 are then attached to the stands 2 and 3 at the end of the assembly remote from the gauge bar 9. Again, similar locking bolts on each ramp 7, 8 can be engaged by sliding them towards the stands. The stops 18 at the front end of each stand 1, 4 furthest from the ramps 7 and 8 are then raised and retained in their raised positions by pawls 30 (see FIGS. 7*a* and 7*b*) acting on toothed edges of each stop 18. Fixing of the stops 18 in the required positions can be checked by noting that release levers 31 (FIG. 7*a*) are horizontal.

The vehicle on which work is to be carried out is then driven up the ramps 7 and 8 and across the bridges 5 and 6 so that the four wheels of the vehicle rest squarely on the horizontal upwardly presented surfaces of the stands 1, 2, 3 and 4 between the side walls 22.

If the vehicle is very long or needs to be kept off the ground while being moved forwards, further pairs of stands and bridges can be added to form a raised support track.

Once the vehicle is in position, the stops 18 nearest the ramps 7 and 8 should be raised and, as the gauge bar 9 is no longer needed, it can safely be removed until the next time that it is needed. In addition, in order to provide maximum clear floor space around the underside of the vehicle, the ramps 7 and 8 and the bridges 5 and 6 should also be removed, leaving the vehicle supported on the four stands 1, 2, 3 and 4.

To remove the bridges 5 and 6, having first disengaged the locking bolts 27 where necessary, the pedals 19 are depressed and locked down by tilting them, thereby moving the castor wheels 24 into their ground-engaging positions and lifting the feet 25 clear of the ground. This moves the bridges 5 and 6 bodily upwardly and disengages the co-operating formations 21 and 26 from the latch brackets 20 on the stands 1, 2, 3 and 4. The bridges 5 and 6 can then be wheeled out sideways on the castor wheels 24 without any risk of damaging the vehicle. To remove the ramps 7 and 8, having disengaged the locking bolts 27 where necessary, the ends of the ramps 7 and 8 adjacent the stands 2 and 3 are raised, disengaging the co-operating formations 23 and 26 on the ramps 7 and 8 from the latch brackets 20 on the stands 2 and 3. The ramps 7 and 8 are then moved away.

Once the work on the vehicle has been completed, the stand system is reassembled to allow the vehicle to be driven off the stands 1, 2, 3 and 4. To do this, the bridges 5 and 6 are wheeled back into their original positions (with their lengths unchanged) and then lowered to the ground, by releasing the pedals 19, thereby allowing the castor wheels 24 to rise and moving the feet 25 into engagement with the ground. Lowering of the bridges 5 and 6 reconnects the co-operating formations 21 and 26 to the latch brackets 20. The ramps 7 and 8 are than either put back into their original positions and the rear stops 18 lowered, so that the vehicle can be reversed off the stands 1, 2, 3 and 4, or placed at the other end of the assembly and the front stops 18 lowered, so that the vehicle can be driven forwardly off the stands 1, 2, 3 and 4.

It is to be noted that the four stands 1, 2, 3 and 4 are of identical construction, as are the two bridges 5 and 6 and the two ramps 7 and 8, so that no part of the assembly has a rigid position and the parts can be used interchangeably. In addition, the gauge bar 9 can be reversed and attached between the two rear stands, as opposed to the two front stands.

The locking bolts 27 will normally only be engaged when the vehicle stand system is being used on uneven ground or is likely to be abused, for example, by being subject to vehicles being braked heavily or accelerated hard when mounting the stand system or dismounting therefrom.

It is also to be noted that, if it is desired to raise only one side of the vehicle, only two stands, one bridge and one ramp will be required. Equally, if it is desired to raise only the front of the vehicle, only two stands, the gauge bar and the two ramps will be required.

In use, the bridges 5 and 6 and the ramps 7 and 8 are connected rigidly to the stands 1, 2, 3 and 4 so that accurate alignment is ensured, both horizontally and vertically. Once the stands 1, 2, 3 and 4, the bridges 5 and 6 and the ramps 7 and 8 have been coupled together, only very limited relative horizontal or vertical rotational movement between the parts of the stand system is permitted. Thus FIG. 7*b* shows the engagement of a tongue of the co-operating formation 21 in a first slot in the bracket 20 and the engagement of the end of the locking bolt 27 in a second slot in the bracket 20. The bolts 27 serve to lock the bridges 5 and 6 securely to the stands 1, 2, 3 and 4.

The telescopic construction of the bridges 5 and 6 ensures that the vehicle stand system can be used for vehicles of different lengths and the adjustable length of the gauge bar 9 ensures that the vehicle stand system can be used for vehicles of different widths.

The invention claimed is:

1. A vehicle stand system comprising a plurality of stands each of which includes an upwardly presented support surface for supporting a wheel of a vehicle, vehicle stops on the stands, means for moving the stops between operative and inoperative positions, a plurality of ramps having means for releasable attachment to the stands whereby the bridge pieces can be arranged to interconnect the stands, the bridge pieces being adjustable in length whereby the spacing between the stands can be adjusted in dependence on the spacing between the front and rear wheels of the vehicle, in which the bridge pieces include platforms mounted on wheels, and the wheels of the bridge pieces are castors which are movable between ground-engaging positions, (to facilitate movement of the bridge pieces into and out of engagement with the stands, and raised positions clear of the ground.

2. A vehicle stand system as claimed in claim 1, in which the means for releasable attachment of the bridge pieces to the stands are such that, when the castors are moved from their ground-engaging positions into their raised positions, the releasable attachment means are moved into engagement with co-operating means on the stands.

3. A vehicle stand system as claimed in claim 2, in which the arrangement is such that disengagement of the releasable attachment means is effected by moving the castors from their raised positions into their ground-engaging positions.

4. A vehicle stand system as claimed in claim 1, in which the bridge pieces are of channel-section.

5. A vehicle stand system as claimed in claim 1, which includes a gauge bar for interconnecting two of the stands.

6. A vehicle stand system as claimed in claim 5, in which the gauge bar is adjustable in length in dependence on the spacing of the front or rear wheels of the vehicle.

7. A vehicle stand system as claimed in claim 6, in which the gauge bar is provided at its ends with means for releasable attachment to the stands.

8. A vehicle stand system as claimed in claim 1, in which the ramps are of channel section and are provided at their upper ends with means for releasable attachment to the stands.

9. A vehicle stand system as claimed in claim 1, which includes means for limiting pivotal movement of the bridge pieces relative to the stands.

10. A vehicle stand system as claimed in claim 1, which includes means for locking the bridge pieces to the stands.

11. A vehicle stand system as claimed in claim 1, in which the means for limiting pivotal movement of the bridge pieces relative to the stands includes tongues which engage in slots in brackets.

* * * * *